US009222252B1

(12) United States Patent
Williams

(10) Patent No.: US 9,222,252 B1
(45) Date of Patent: Dec. 29, 2015

(54) FOUNDATION WALL AND FLOOR SLAB DRAIN

(71) Applicant: Henry Williams, Nanuet, NY (US)

(72) Inventor: Henry Williams, Nanuet, NY (US)

( * ) Notice: Subject to any disclaimer, the term of this patent is extended or adjusted under 35 U.S.C. 154(b) by 0 days.

(21) Appl. No.: 14/792,687

(22) Filed: Jul. 7, 2015

(51) Int. Cl.

| | |
|---|---|
| ***E02D 19/00*** | (2006.01) |
| ***E04B 1/70*** | (2006.01) |
| ***E04B 5/16*** | (2006.01) |
| ***E04B 2/02*** | (2006.01) |

(52) U.S. Cl.
CPC ... *E04B 1/70* (2013.01); *E04B 2/02* (2013.01); *E04B 5/16* (2013.01)

(58) Field of Classification Search
CPC ..... E04B 1/70; E04B 2/02; E04B 5/16
USPC ..... 52/302.3, 169.5, 274
See application file for complete search history.

(56) References Cited

U.S. PATENT DOCUMENTS

| | | | | |
|---|---|---|---|---|
| 3,654,765 | A * | 4/1972 | Healy | E02B 11/005 210/346 |
| 4,745,716 | A * | 5/1988 | Kuypers | E04F 17/00 405/43 |
| 4,757,651 | A * | 7/1988 | Crites | E02D 31/02 137/362 |
| 5,495,696 | A | 3/1996 | Repka | |
| 5,794,388 | A * | 8/1998 | Jackman | E04B 1/7023 405/36 |
| D456,911 | S | 5/2002 | Janesky | |
| 6,672,016 | B2 | 1/2004 | Janesky | |
| 7,543,413 | B2 | 6/2009 | Sourlis | |
| 7,832,150 | B1 * | 11/2010 | Pratt | E04B 1/7023 52/169.5 |
| 7,918,055 | B2 * | 4/2011 | Cotten | E04B 1/7023 52/169.14 |
| 8,297,005 | B1 * | 10/2012 | Bramble | E02D 31/002 52/169.5 |
| 8,596,019 | B2 | 12/2013 | Aitken | |
| 8,919,062 | B1 * | 12/2014 | Viness | E04F 13/0875 52/220.5 |
| 2003/0037499 | A1 * | 2/2003 | Coulton | E04B 1/7046 52/302.3 |
| 2007/0163191 | A1 | 7/2007 | Berry | |
| 2007/0180785 | A1 | 8/2007 | Trotter | |

* cited by examiner

*Primary Examiner* — Brian Glessner
*Assistant Examiner* — Paola Agudelo
(74) *Attorney, Agent, or Firm* — Kyle A. Fletcher, Esq.

(57) ABSTRACT

The foundation wall and floor slab drain is a device that is designed to control the buildup of mold in basements by enabling the water that drains from wall to be channeled into a French drain that is provided there under. The device is installed during construction of the footing, foundation wall, and floor slab. The device is further defined as an elongated planar member with a plurality of tubes linearly aligned thereon, and which collectively form an assembly. Both the elongated member and the plurality of tubes are bent to form a right angle. A vertical portion of the assembly is adapted to interface against a foundation wall and a side surface of a floor slab. A horizontal portion of the assembly is adapted to interface between a bottom surface of the floor slab and a top surface of a footing.

18 Claims, 3 Drawing Sheets

FOUNDATION WALL AND FLOOR SLAB DRAIN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of construction, more specifically, a drain that is adapted to interface between a foundation wall and a floor slab.

SUMMARY OF INVENTION

The foundation wall and floor slab drain is a device that is designed to control the buildup of mold in basements by enabling the water that drains from wall to be channeled into a French drain that is provided there under. The device is installed during construction of the footing, foundation wall, and floor slab. The device is further defined as an elongated planar member with a plurality of tubes linearly aligned thereon, and which collectively form an assembly. Both the elongated member and the plurality of tubes are bent to form a right angle. A vertical portion of the assembly is adapted to interface against a foundation wall and a side surface of a floor slab. A horizontal portion of the assembly is adapted to interface between a bottom surface of the floor slab and a top surface of a footing. The horizontal portion extends beyond the footing to enable water to access gravel and the French drain located adjacent both the footing and the floor slab.

These together with additional objects, features and advantages of the foundation wall and floor slab drain will be readily apparent to those of ordinary skill in the art upon reading the following detailed description of the presently preferred, but nonetheless illustrative, embodiments when taken in conjunction with the accompanying drawings.

In this respect, before explaining the current embodiments of the foundation wall and floor slab drain in detail, it is to be understood that the foundation wall and floor slab drain is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the foundation wall and floor slab drain.

It is therefore important that the claims be regarded as including such equivalent construction insofar as they do not depart from the spirit and scope of the foundation wall and floor slab drain. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
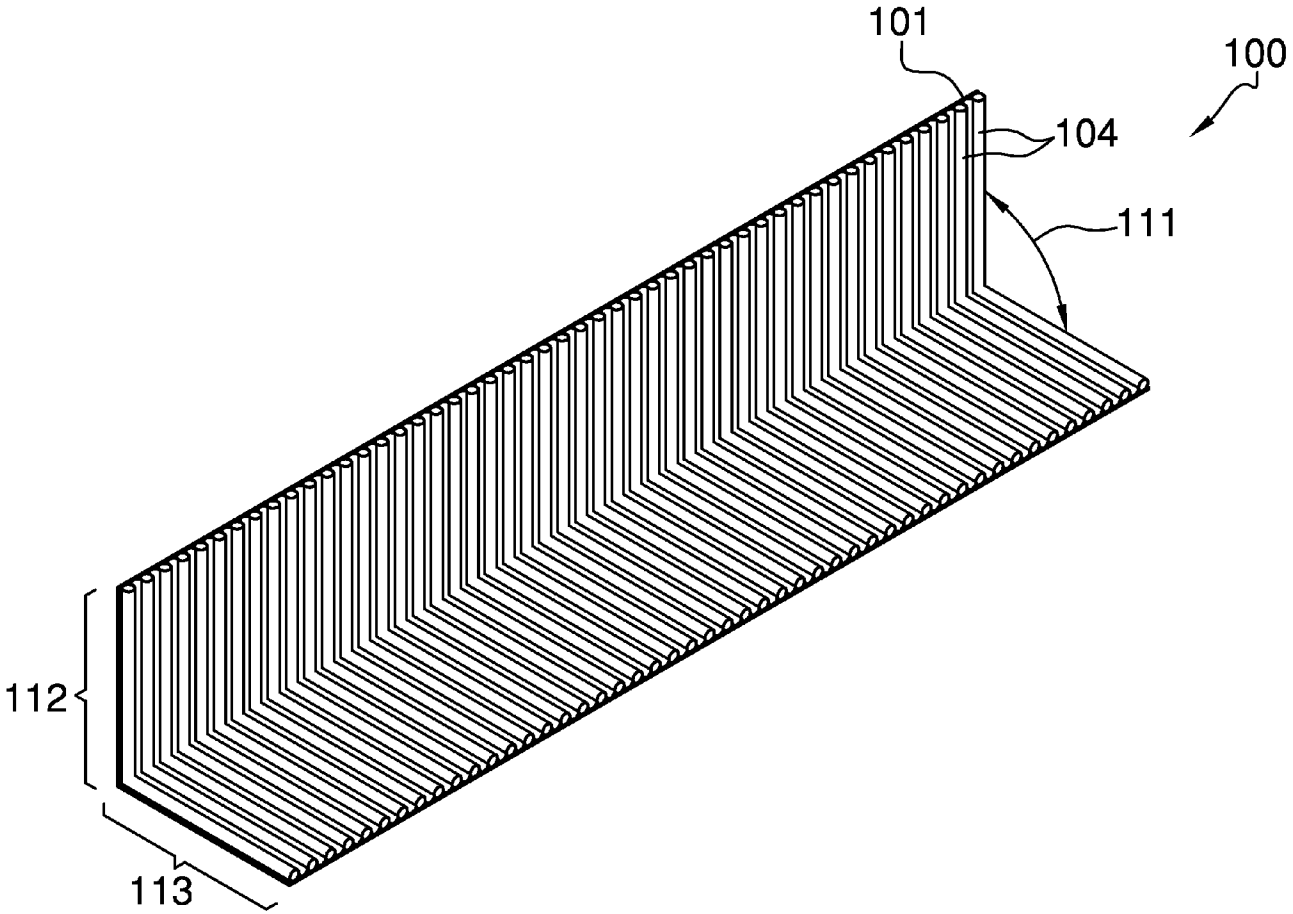
FIG. 1 is a perspective view of an embodiment of the disclosure.
Figure 2:
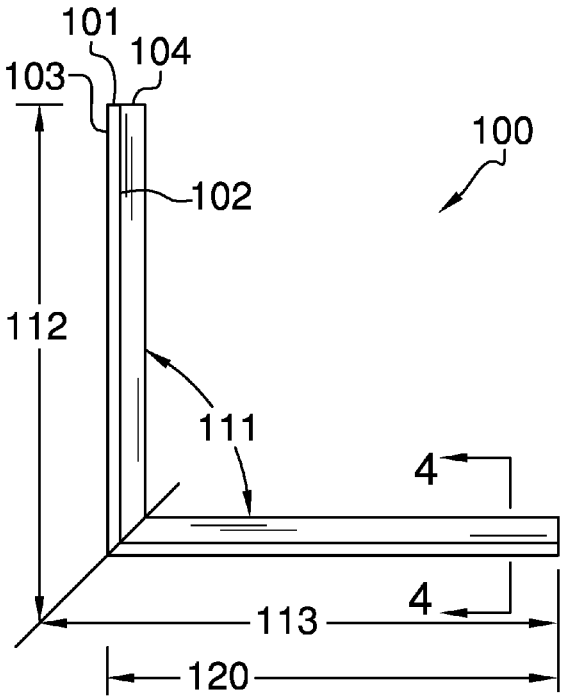
FIG. 2 is a side view of an embodiment of the disclosure.
Figure 3:
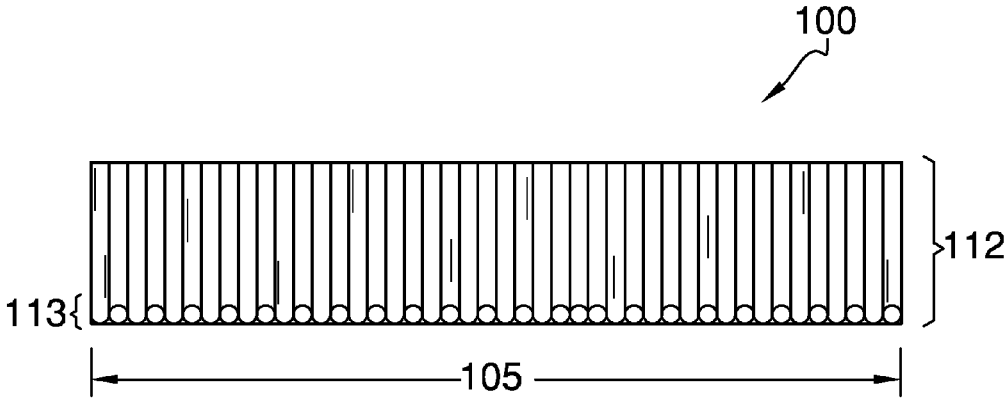
FIG. 3 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The foundation wall and floor slab drain 100 (hereinafter invention) comprises a planar member 101 that is further defined with a first surface 102 and a second surface 103. Affixed to the first surface 102 of the planar member 101 is a plurality of tubes 104. The plurality of tubes 104 are linearly aligned along a width 105 of the invention 100. The width 105 of the invention 100 ranges from not less than 3 inches, to not more than 10 feet.

Figure 4:
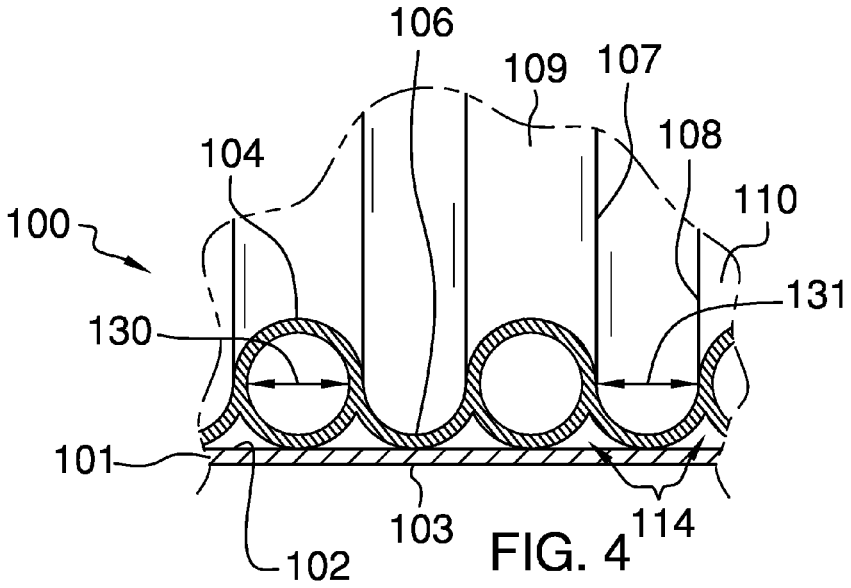
FIG. 4 is a detailed view of an embodiment of the disclosure.

The plurality of tubes 104 are linearly aligned, and separated from one another via one of a plurality of hemi-cylindrical members 106. The plurality of hemi-cylindrical members 106 is positioned in between successive ones of the plurality of tubes 104. Moreover, the plurality of hemi-cylindrical members 106 is parallel with one another as well as with the plurality of tubes 104. Referring to FIG. 4, the plurality of tubes 104 are each further defined with a first tube side 107 and a second tube side 108. The first tube side 107 is opposite the second tube side 108. One of the plurality of hemi-cylindrical members 106 abuts the first tube side 107 of a first tube 109 and the second tube side 108 of a second tube 110. It shall be noted that the plurality of tubes 104 and the plurality of hemi-cylindrical members 106 may have an inner diameter 130 or inner-curvature 131 that are equal to one another, and are no less than 0.0625 inches.

The invention 100 is folded to form a right angle 111. The right angle 111 differentiates a vertical portion 112 from a horizontal portion 113. The vertical portion 112 and the horizontal portion 113 may be equal in length. The planar member 101 and the plurality of tubes 104 as well as the plurality of hemi-cylindrical members 106 are each bent to form the right angle 111, but maintain fluid communication between the vertical portion 112 and the horizontal portion 113. The right angle 111 enables water to flow down the plurality of tubes 104 from the vertical portion 112 to the horizontal portion 113. It shall be noted that the invention 100 creates additional conduits 114 that are formed between the planar member 101 and both the plurality of tubes 104 as well as the plurality of hemi-cylindrical members 106.

The planar member 101, the plurality of tubes 104, and the plurality of hemi-cylindrical members 106 are made of a metal, carbon fiber composite, or plastic. Moreover, the components of the invention 100 are either welded or molded together.

Figure 5:
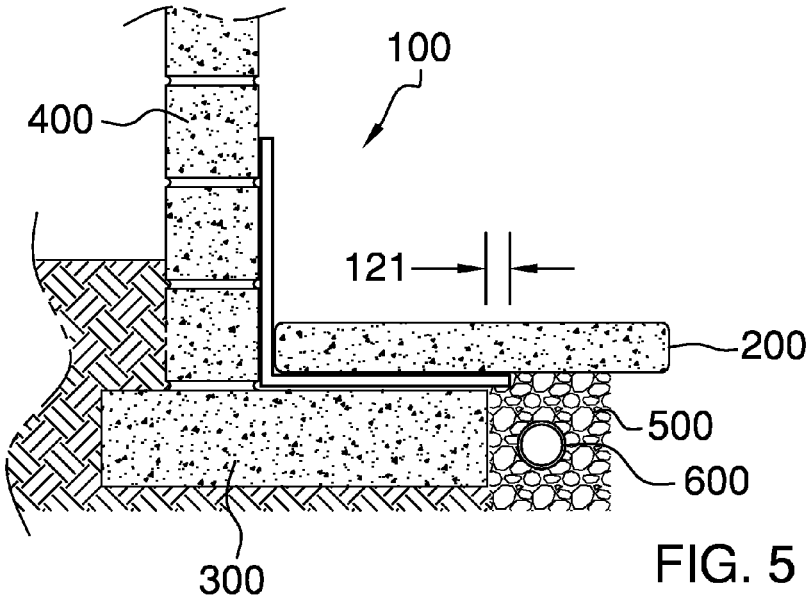
FIG. 5 is a side view of an embodiment of the disclosure in use.

Referring to FIG. 5, the invention 100 is installed during construction of a building. Moreover, the invention 100 is adapted to be positioned in between a floor slab 200, a footing 300, a foundation wall 400, and gravel 500 above a French drain 600. More specifically, the vertical portion 112 is adapted to be sandwiched between an inner wall surface 401 of the foundation wall 400, and an outer perimeter slab surface 201 of the floor slab 200. The horizontal portion 113 is adapted to be sandwiched between a top foundation surface 301 of the foundation 300 and a bottom slab surface 202 of the floor slab 200.

The horizontal portion 113 of the invention 100 is further defined with a depth 120. The depth 120 extends the horizontal portion 113 beyond the foundation 300. The depth 120 may range from a few inches to several feet. A protrusive portion 121 of the horizontal portion 113 extends beyond the foundation 300, and enables water to be dispensed directly into the gravel 500 associated with the French drain 600. The protrusive portion 121 is not less than 0.25 inches. The invention 100 enables water that collects on the slab floor 200 to be drained to the French drain 600 located there under.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A foundation wall and floor slab drain comprising:

a planar member from which a plurality of tubes are affixed in linear alignment;

wherein the planar member and the plurality of tubes are bent forming a right angle that separates a vertical portion and a horizontal portion;

wherein the vertical portion is adapted to be sandwiched between a foundation wall and a floor slab;

wherein the horizontal portion is adapted to be sandwiched between a footing and the floor slab;

wherein water is able to drain from the vertical member to the horizontal member where gravel and a French drain are located;

wherein the plurality of tubes are linearly aligned, and separated from one another via one of a plurality of hemi-cylindrical members.

2. The foundation wall and floor slab drain according to claim 1 wherein the planar member is further defined with a first surface and a second surface.

3. The foundation wall and floor slab drain according to claim 2 wherein affixed to the first surface of the planar member is the plurality of tubes; wherein the plurality of tubes are linearly aligned along a width.

4. The foundation wall and floor slab drain according to claim 3 wherein the plurality of hemi-cylindrical members is positioned in between successive ones of the plurality of tubes.

5. The foundation wall and floor slab drain according to claim 4 wherein the plurality of hemi-cylindrical members is parallel with one another as well as with the plurality of tubes.

6. The foundation wall and floor slab drain according to claim 5 wherein the plurality of tubes are each further defined with a first tube side and a second tube side; wherein the first tube side is opposite the second tube side; wherein one of the plurality of hemi-cylindrical members abuts the first tube side of a first tube and the second tube side of a second tube.

7. The foundation wall and floor slab drain according to claim 6 wherein the right angle maintains fluid communication between the vertical portion and the horizontal portion.

8. The foundation wall and floor slab drain according to claim 7 wherein additional conduits are formed between the planar member and both the plurality of tubes as well as the plurality of hemi-cylindrical members; wherein the additional conduits also enable water to drain into the gravel and French drain located under the floor slab.

9. The foundation wall and floor slab drain according to claim 8 wherein the vertical portion is adapted to be sandwiched between an inner wall surface of the foundation wall, and an outer perimeter slab surface of the floor slab.

10. The foundation wall and floor slab drain according to claim 9 wherein the horizontal portion is adapted to be sandwiched between a top foundation surface of the foundation and a bottom slab surface of the floor slab.

11. The foundation wall and floor slab drain according to claim 10 wherein the horizontal portion is further defined with a depth; wherein the depth extends the horizontal portion beyond the foundation; wherein the plurality of tubes each have an inner diameter; wherein the plurality of hemi-cylindrical members each have an inner-curvature; wherein the inner diameter is equal to the inner-curvature.

12. The foundation wall and floor slab drain according to claim 11 wherein a protrusive portion of the horizontal portion extends beyond the foundation, and enables water to be dispensed directly into the gravel associated with the French drain.

13. A foundation wall and floor slab drain comprising:

a planar member from which a plurality of tubes are affixed in linear alignment;

wherein the planar member and the plurality of tubes are bent forming a right angle that separates a vertical portion and a horizontal portion;

wherein the vertical portion is adapted to be sandwiched between a foundation wall and a floor slab;

wherein the horizontal portion is adapted to be sandwiched between a footing and the floor slab;

wherein water is able to drain from the vertical member to the horizontal member where gravel and a French drain are located;

wherein the planar member is further defined with a first surface and a second surface;

wherein affixed to the first surface of the planar member is the plurality of tubes; wherein the plurality of tubes are linearly aligned along a width;

wherein the plurality of tubes are linearly aligned, and separated from one another via one of a plurality of hemi-cylindrical members; wherein the plurality of hemi-cylindrical members is positioned in between successive ones of the plurality of tubes.

14. The foundation wall and floor slab drain according to claim 13 wherein the plurality of hemi-cylindrical members is parallel with one another as well as with the plurality of tubes; wherein the plurality of tubes are each further defined with a first tube side and a second tube side; wherein the first tube side is opposite the second tube side; wherein one of the plurality of hemi-cylindrical members abuts the first tube side of a first tube and the second tube side of a second tube.

15. The foundation wall and floor slab drain according to claim 14 wherein the right angle maintains fluid communication between the vertical portion and the horizontal portion.

16. The foundation wall and floor slab drain according to claim 15 wherein additional conduits are formed between the planar member and both the plurality of tubes as well as the plurality of hemi-cylindrical members; wherein the additional conduits also enable water to drain into the gravel and French drain located under the floor slab.

17. The foundation wall and floor slab drain according to claim 16 wherein the vertical portion is adapted to be sandwiched between an inner wall surface of the foundation wall, and an outer perimeter slab surface of the floor slab; wherein the horizontal portion is adapted to be sandwiched between a top foundation surface of the foundation and a bottom slab surface of the floor slab.

18. The foundation wall and floor slab drain according to claim 17 wherein the horizontal portion is further defined with a depth; wherein the depth extends the horizontal portion beyond the foundation; wherein a protrusive portion of the horizontal portion extends beyond the foundation, and enables water to be dispensed directly into the gravel associated with the French drain wherein the plurality of tubes each have an inner diameter; wherein the plurality of hemi-cylindrical members each have an inner-curvature; wherein the inner diameter is equal to the inner-curvature.

* * * * *